United States Patent [19]

Miyazaki

[11] 4,271,494

[45] Jun. 2, 1981

[54] CORRECTING DEVICE FOR CALENDAR IN AN ANALOG TYPE ELECTRONIC WATCH

[75] Inventor: Joichi Miyazaki, Tokyo, Japan

[73] Assignee: Kabushiki Kaisha Daini Seikosha, Tokyo, Japan

[21] Appl. No.: 948,783

[22] Filed: Oct. 5, 1978

[30] Foreign Application Priority Data

Oct. 6, 1977 [JP] Japan ..... 52/120302

[51] Int. Cl.[3] ..... G04B 19/24

[52] U.S. Cl. ..... 368/34; 368/28; 368/202

[58] Field of Search ..... 58/23 R, 23 D, 85.5, 58/4 R, 4 A, 58; 368/28, 34, 202

[56] References Cited

U.S. PATENT DOCUMENTS

| | | | |
|---|---|---|---|
| 3,518,825 | 7/1970 | Nissen | 58/4 R |
| 3,827,234 | 8/1974 | Imanishi | 58/58 |
| 4,026,100 | 5/1977 | Kume et al. | 58/4 R |
| 4,142,363 | 3/1979 | Guyot et al. | 58/58 |

*Primary Examiner*—Ulysses Weldon

*Attorney, Agent, or Firm*—Robert E. Burns; Emmanuel J. Lobato; Bruce L. Adams

[57] ABSTRACT

A calendar mechanism of a motor driven analog timepiece is automatically adjusted, at the end of a 30-day month to the first day of the next month. A month detecting circuit distinguishes between 30-day months and 31-day months, and at the end of the 30th day of a 30-day month it controls the timepiece motor to run backward and then forward at a relatively high speed to change the calendar to the first day of the month. Circuitry is also provided to distinguish between 28 and 29-day months, and to correct the date displayed at the end of February in a similar manner.

16 Claims, 12 Drawing Figures

33
34
35
36
37
38
39
40
41
42
43
44
45
46
47
48
49
50
51
52
53
54
55
56
57
58
59
60
61
62
63
64
65
66
67
68
69
9
22
27
28
29
30
31
32
VDD
FF
CL
S
Q
R

CORRECTING DEVICE FOR CALENDAR IN AN ANALOG TYPE ELECTRONIC WATCH

BACKGROUND OF THE INVENTION

The present invention relates to a correcting device for calendar in an analog type electronic watch.

Today, a watch having a calendar mechanism for displaying date and/or day is a very commonly article. In an analog type electronic watch in which time is displayed by pointers by use of the oscillation of the vibrator, such as quartz, such calendar mechanism is also employed. Such calendar mechanism in the watch is adapted to send a date plate on which the letter of the first day through the thirty-first day are printed every one frame per day. According to this mechanism, after the thirtieth day, the thirty-first day is displayed automatically. Therefore, when changing from the end of the even month which have not the thirty-first day to an odd month, it is always necessary to correct the date from the thirty-first day to the first day by operating of the correcting device for the calendar. For this reason, a person using the watch must direct his attention to the end of the even month or the first of the odd month. If he does not correct the date, the date displayed differs from the normal date. In analog type electronic watchs, generally, the operational procedure of a winding stem is set in such a manner that the calendar correcting function can be performed at the second step of the winding stem and reset operation for an electronic circuit can be performed at the third step of the winding stem. Therefore, at the time when the winding stem is pulled out to the second step in order to correct the calendar, due to force beyond the necessary force for pulling out, the winding stem is liable to be pulled out to the third step. As a result of which, there is a danger in which the reset switch is turned on and the watch is stopped.

In the prior art, to prevent such danger and to easily correct the calendar, various correcting device for the calendar have been proposed. However, any proposed correcting device for the calendar is complex in construction and requires many parts so that the cost is high and the volume is large, therefore, this correcting device for calendar is unsuitable for general popular wrist watches.

An object of the present invention is to provide a correcting device for a calendar wherein a calendar correcting operation in an analog type electronic watch can be made automatically, a correcting operation is not required even when changing the month from an even month to an odd month, the above-mentioned danger of stopping the watch by the error-operation of the winding stem can be eliminated, the construction is not complicated and small, and the cost is low.

Hereinafter, one embodiment of the present invention will be explained with respect to a correcting device for a calendar in conjunction with the accompanying drawings.

Figure 1:
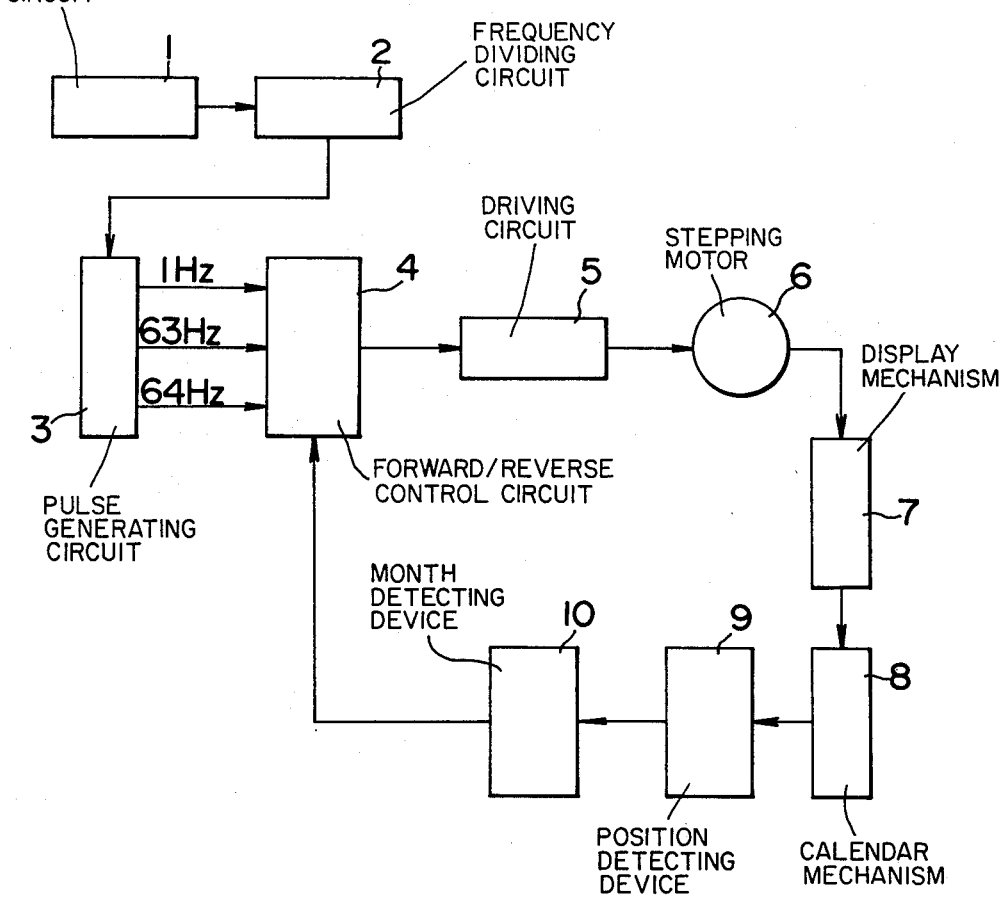
FIG. 1 is a block diagram which shows embodiment of a correcting device for calendar in an analogue type electronic watch according to the present invention.

In FIG. 1, an embodiment of a correcting device for a calendar in an analog type electronic watch according to the present invention is shown. An oscillating circuit 1 comprising a quartz vibrator or the like generates an original signal having a predetermined frequency as the base for time measuring. An oscillating signal from the oscillating circuit 1 is divided in frequency by a frequency divider 2 consisting of a plurality of cascaded frequency dividing stages and the output from a predetermined frequency dividing stage is applied to a pulse generating circuit 3. In this embodiment, the pulse generating circuit 3 is constructed so as to generate a pulse having the frequency of 1 Hz, a pulse having the frequency of 63 Hz and a pulse having the frequency of 64 Hz. Since constructing the pulse generating circuit 3 by using logic circuit can be realized easily, in FIG. 1 the detailed circuit diagram is omitted. Each of output pulses from the pulse generating circuit 3 is supplied to a forward/reverse rotation control circuit 4, and these output pulses are applied to a drive circuit 5 selectively. The output pulse from the forward/reverse rotation control circuit 4 is a pulse having the frequency of 1 Hz, normally, and the drive circuit 5 drives a stepping motor 6 by one step per 1 second in response to the output pulse. Numerical reference 7 indicates an analog display mechanism for displaying the time by pointer driven by the stepping motor as a driving source, and numerical reference 8 indicates a calendar mechanism for displaying a date and a day in cooperation with the display mechanism 7. As undermentioned, the calendar mechanism 8 has a date plate on which letters 1 through 31 for date are printed and a date driving wheel sending the date plate by one frame per day. Numerical reference 9 is position detecting device for detecting a starting position where sending the date driving wheel is started and a finishing position where sending the date driving wheel is finished, and in accordance with the output signal thereof an instruction signal for forward rotating or an instruction signal for reverse rotating is produced from a month detecting device 10 to the forward/reverse rotation control circuit 4.

The above-mentioned device operates as follows; when changing the month from any one of the odd months such as January, March, May, July, August, October, December to the next month thereof, the month change detecting device 10 does not detect changing in month, the forward/reverse rotation control circuit continue to send the pulse having frequency of 1 Hz to the drive circuit 5, as a result of which, the date displayed by the calendar mechanism 8 changes from the thirty-first day to the first day of the next month automatically in accordance with the calendar. On the other hand, when changing in month from any one of the even months such as February, April, June, September, November to the next month thereof, the month change detecting device 10 detects the month change in response to a detection signal from the position detecting device which is produced at the time when the date displayed by the calendar mechanism 8 just changed from the thirtyth day to the thirty-first day, the forward/reverse rotation control circuit 4 supplies the pulse having a frequency of 63 Hz instead of the pulse of 1 Hz to the drive circuit 5 in response to the detection output from the month change detecting device 10, and at the same time the stepping motor 6 is operated so as to rotate in the reverse direction. As a result of which, the stepping motor 6 is driven to rotate in the reverse direction with higher speed than a normal speed, and the display device 7 and the calendar mechanism 8 are operated so as to drive in the reverse direction. When the position of the date driving wheel of the calendar mechanism 8 returns to the starting position from finishing position by driving in the reverse direction, the above condition is detected by the positional detecting device 9, the detection output is applied to the month change detecting device 10, the forward/reverse rotation control circuit 4 stops the reverse rotation of the stepping motor 6 by the output from the circuit 4, and then the stepping motor 6 is rotated in the forward direction with high speed by supplying the pulse having a frequency of 63 Hz to the drive circuit 5. When the date driving wheel is rotated in the reverse direction, since the date plate is not moved, the date displaying keeps the condition of the thirty-first day. The date driving wheel is also rotated from the starting position by the high speed rotation of the stepping motor 6, the date plate is advanced by one frame, and the date displayed is changed to the first day from the thirty-first day. As described in detail hereinafter, the times required for forward rotating and reverse rotating at the time of calendar correction are measured by counting the pulse of 64 Hz having difference by 1 Hz and the pulse of 63 Hz, the forward/reverse rotation control circuit 4 stops the stepping motor 6 to rotate in the forward direction with high speed at the time when the display time of the display mechanism 7 becomes normal time. As seen from above explanation of operation, at the time of changing to the next month from the end of the even month the date plate of the calendar mechanism 8 is driven so as to display the first day by jumping the thirty-first day rapidly. As a result, the calendar can be corrected automatically.

Next, detailed explanation of each portion indicated by blocks in FIG. 1 will be made in conjunction with other drawings.

Figure 2:
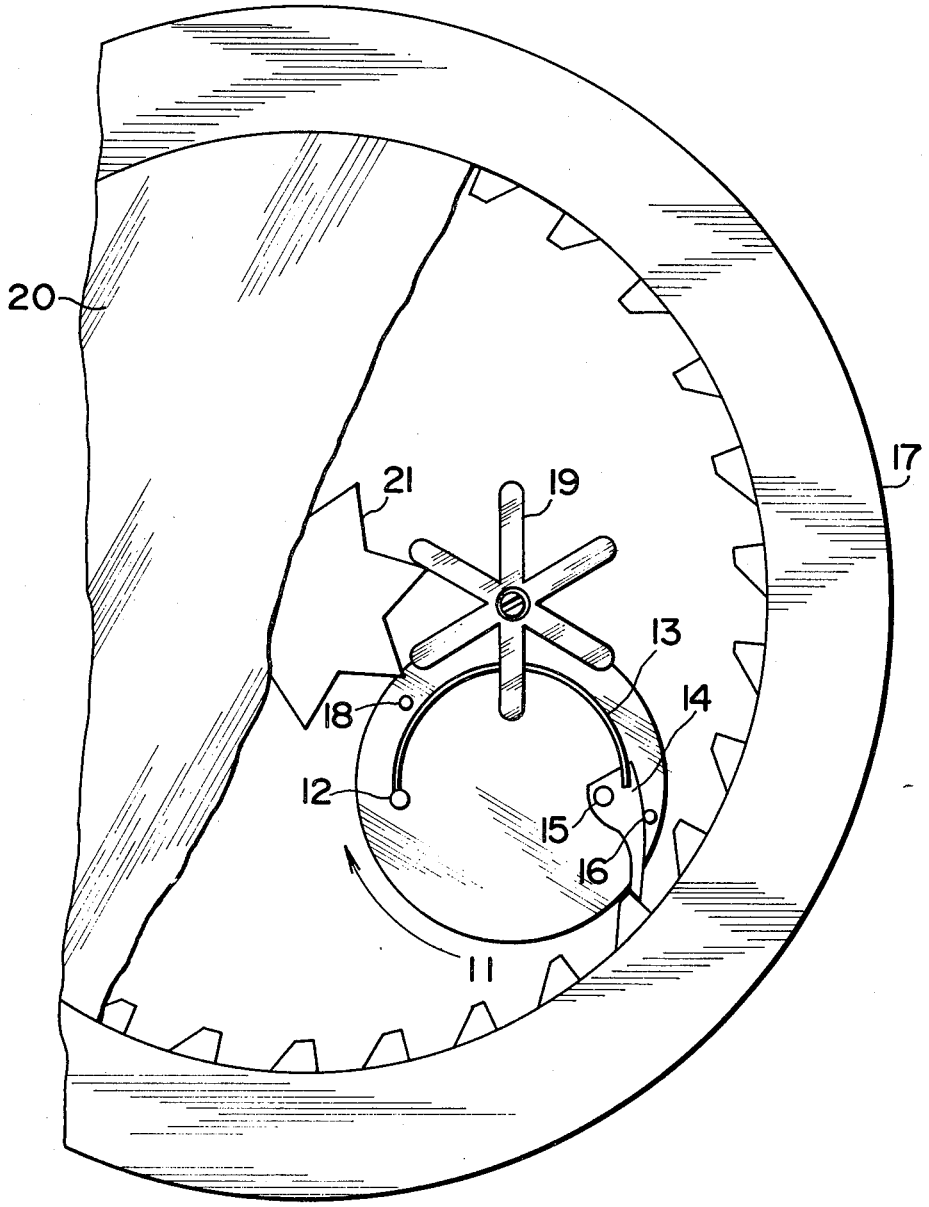
FIG. 2 is an outline view which shows a portion of a calendar mechanism in FIG. 1.

FIG. 2 shows a portion of the calendar mechanism 8, and numeral reference 11 indicates a date driving wheel which interlocks with the display mechanism 7 and rotates a turn of revolution per 24 hours. The tail portion of a date sending finger 14 is tightly mounted to the tip portion of a spring 13 other end portion of which is tightly mounted to a pin 12 fixedly mounted to the date driving wheel 11. The date sending finger 14 is pivotaly mounted to a pin 15 fixedly mounted to the date driving wheel 11 in order that the date sending finger 14 can be rotate, the rear of the date sending finger 14 is in forcedly contact with a pin 16 secured to the date driving wheel 11 by the elasticity of the spring 13. The date driving wheel 11 is normally driven to rotate in the direction shown by the arrow mark, and the date plate 17 on which date letters from the first day to the thirty-first day is printed is arranged in such a way that the frame thereof can be seen the rotational region of the date sending finger 14 rotating together with the date driving wheel 11. Therefore, the tip portion of the date sending finger 14 is in contact with the frame of the date plate with the rotation of the date driving wheel 11, and the date plate is sent by one frame. When the date driving wheel 11 rotates in the reverse direction, the rear portion of the date sending finger 14 comes into contact with the frame of the date plate 11, the date sending finger 14 is rotated around the pin 15 as a center in the right direction against the spring force of the spring 13. As a result of which, the date sending plate 14 gets over the frame of the date plate 17 and returns to the original position. At this time the date plate 17 remains to stop. Numeral 20 is a date plate on the face of which letters showing days is printed, and the date plate has a day star wheel 21 on the back. The day star wheel 21 rotates 1/7 turn per 24 hours with the rotation of the date driving wheel 11 through a pin 18 fixed to the date driving wheel 11 and a day driving wheel 19. The day plate 20 rotates together with the day star wheel 21, and in this case the relative position between the position of the pin 18 and the position of the date sending finger 14 is controlled in order that the time band for the rotation of the day plate 20 is not coincident with the time band for the rotation of the date plate 17. In this embodiment, the day plate 20 is driven to be sent after the date 17 is sent.

Figure 3:
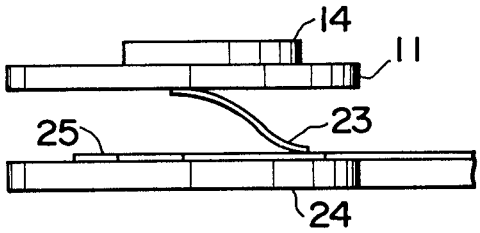
FIG. 3 is a side view which shows roughly a switch being controlled on, off by the rotation of a date driving wheel in FIG. 1.
Figure 4:
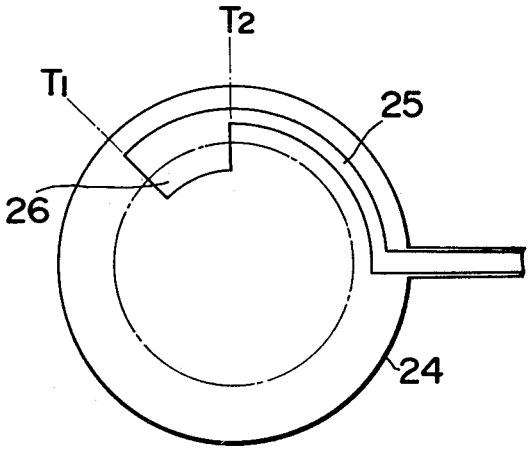
FIG. 4 is a plan view of a switch plate shown in FIG. 3.

In FIGS. 3 and 4, the construction of a switch 22 (shown in FIG. 5) constructing a part of the positional detecting device 9 shown in FIG. 1, and numeral 23 indicates a contact spring one end of which is fixed on the reverse side of the date driving wheel 11. The tip portion of the contact spring 23 is in forcedly contact with a switch plate 24 which is located against the opposite side of the date driving wheel 11 and made of dielectric material, and the contact spring rotates in contact with the upper face of the switch plate 24 as the date driving wheel 11 rotates. In FIG. 4 the circle shown by a chain line indicates a locus of shifting between the contact spring 23 and the switch plate 24. An electrode 25 is formed on the upper surface of the switch plate 24 by use of a conventional technique of printing pattern. The electrode 25 has a projected portion 26 crossing the above-mentioned locus of the contact spring 23, the contact spring 23 is in contact with the electrode 25 as long as the contact spring 23 passes through the projected portion 26, therefore, the switch 22 becomes the close condition. The size of the projected portion 26 of the electrode 25 and the arranged location thereof is determined in order that the starting time of contact between the contact spring 23 and the electrode 25 and cut off time thereof are coincident with the starting time when the date plate 11 is sent by the date driving wheel 11 and the finishing time when the date plate stops to be sent, respectively. In FIG. 4, $T_1$ is the starting position where the date driving wheel 11 starts to send the date plate 17 and $T_2$ is the finishing position where the date driving wheel 11 stops to send the date plate 17.

Figure 5:
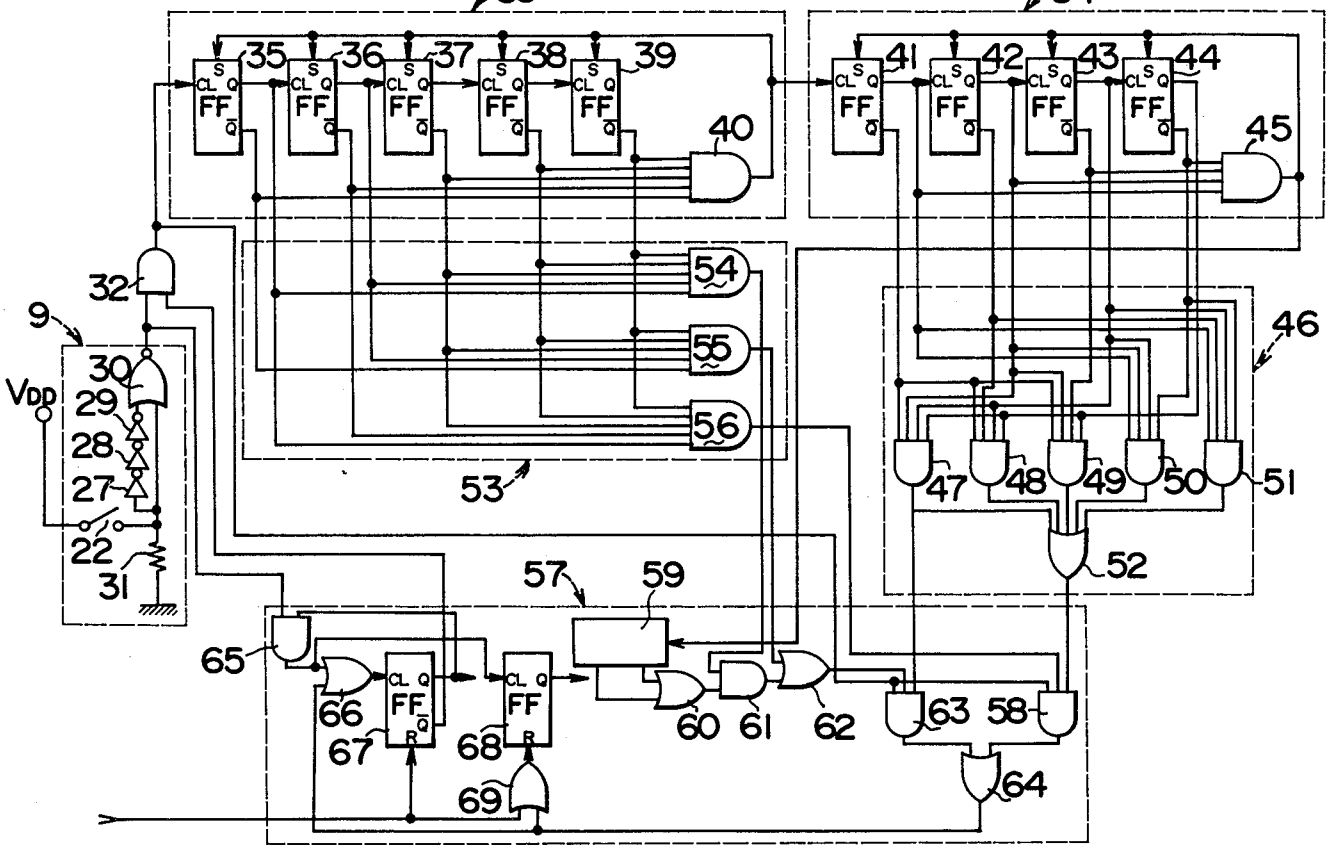
FIG. 5 is a circuit diagram which shows a positional detecting device and a month change detecting device shown in FIG. 1.

The position detecting device 9 shown in FIG. 1, as shown in FIG. 5, consists of the above-mentioned switch 22, inverters 27, 28 and 29 which construct a delay circuit, a NOR gate 30 and a resistor 31. The position detecting device 9 produces a detection pulse having a pulse width changing in response to the delay time of inverters 27, 28 and 29 at the time when the switch 22 becomes an OFF condition from it's ON condition. That is, in the normal condition, the detection pulse is produced from the NOR gate 30 only when the date driving wheel 11 comes to the finishing position $T_2$ where sending the date plate 17 is finished and the switch 22 is turned off, however, as mentioned above, the detection pulse is also produced when the date driving wheel 11 rotates in the reverse direction, it returns to the starting position $T_2$ and the switch 22 becomes the ON condition from the OFF condition.

Figure 6:
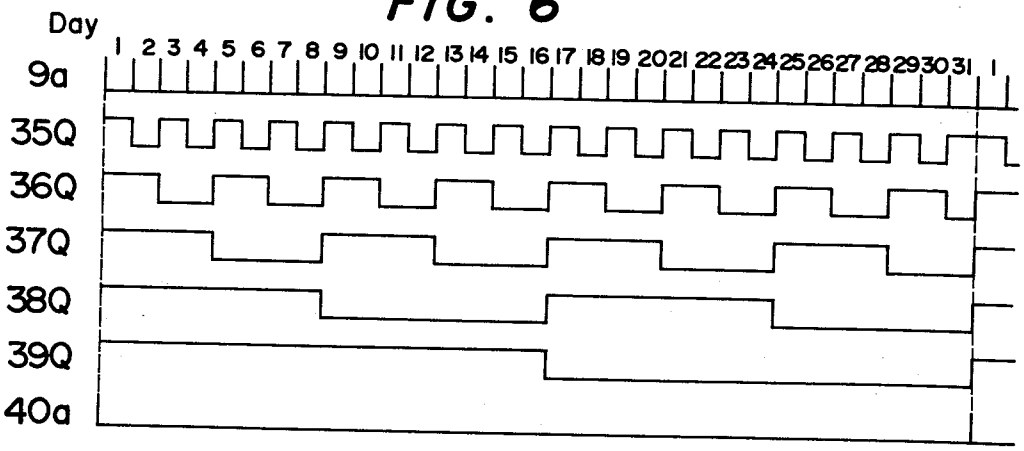
FIG. 6 is a timing chart for explaining the operation of a date counter shown in FIG. 5.
Figure 7:
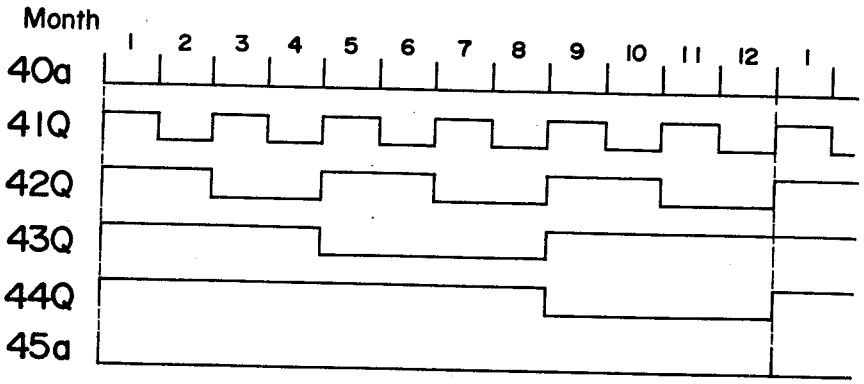
FIG. 7 is a timing chart for explaining the operation of a month counter shown in FIG. 5.

FIG. 5 shows the circuitry of the month change detecting a date counter of a thirty-one advance counter to which the detection pulse produced from the position detecting device 9 at the rate of one pulse to 24 hours and, a month counter 34 of a twelve advance counter which counts a month pulse produced from the date counter 33 at the rate of one pulse a month. The date counter 33 consists of flip-flop circuits (will be referred to as FF, hereinafter) 35, 36, 37, 38 and 39 which are connected in series and, an AND circuit 40 to which each $\overline{Q}$ output of FFs is applied and an output of which is applied to each set terminal of FFs. The month counter 34 consists of FFs 41, 42, 43 and 44 which are connected in series, and an AND circuit 45 to which the Q output of the FF 41, the Q output of the FF 42, the $\overline{Q}$ output of the FF 43 and the $\overline{Q}$ output 44 are applied and the output of which is applied to each set terminal of FFs. FFs 35 to 39 in the date counter 33 and FFs 41 to 44 in the month counter are operated by the rising edge of the pulse applied to each clock terminal thereof. Each Q output of FFs in the date counter 33 vary in response to a detection pulse 9*a* from the positional detecting circuit 9 through an AND circuit 32, and these Q outputs are shown by reference numerals 35Q, 36Q, 37Q and 38Q in FIG. 6. The output of the date counter 33 represents the first day when all Q outputs of FFs 35 through 36 is logical "1", and the calendar mechanism 8 is adjusted in such a way that the calendar mechanism 8 displays the first day at the time. The counting contents of the date counter 33 at the time when each Q outputs of FFs 35 through 39 is "1", "0", "0", "0", "0", respectively, represents the thirty-first day. After this, a set pulse and month pulse 40*a* is produced from the AND circuit 40 the moment all Q outputs of the FFs 36 through 39 become logical "0" in response to a detection pulse 9*a* of the position detecting device 9, and then Q outputs of FFs 35 through 39 is set "1". Each Q output of FFs 41 through 44 in the month counter 34 vary in response to the set pulse and month pulse 40*a* which is the output from the AND circuit 40 and is produced from the date counter 33 at the rate of one pulse a month. These Q outputs are shown by the time chart of FIG. 7 as references 41Q, 42Q, 43Q and 44Q. The counting contents of the month counter 34 at the time when Q outputs of FFs 41 through 44 are "1" represents January and, the counting contents of the month counter 34 at the time when each Q output of FFs 41 through 44 is "0", "0", "1" and "0", respectively represents February. After this, a set pulse and year pulse 50*a* is produced from the AND circuit 45 the moment each Q outputs of FFs 41 through 44 becomes "1", "1", "0" and "0", respectively, in response to the set pulse and month pulse 40*a* from the date counter 33, and then Q outputs of FFs 41 through 44 is set "1".

Numeral reference 46 is a month detecting circuit for detecting that the counting contents of the month counter 34 is the even month e.g. February, April, June, September or November, and the month detecting circuit 46 consists of five AND circuits 47 through 51 to which Q outputs and $\overline{Q}$ outputs of FFs 41 through 44 are applied properly as shown in the figure, and an OR circuit 52 to which the outputs from each AND circuits 47 through 51 are applied. From AND circuits 47 through 51, the signal of logical "1" is produced in turn as the counting contents of the month counter 34 becomes the contents corresponding to February, April, June, September or November. Therefore, the logical condition at the output of the OR circuit 52 becomes "1" when the counting contents of the month counter 34 correspond to the even month.

Numeral reference 53 is a date detecting circuit for detecting that the counting contents of the date counter 33 correspond to the twenty-ninth day, the thirties day or the thirty-first day, the date detecting circuit consists of three AND circuit 54, 55 and 56 to which Q outputs and $\overline{Q}$ outputs of FF 35 through 39 are applied properly as shown in the figure, and from the AND gates 54, 55 and 56, the signal of logical "1" produced in turn as the counting contents of the date counter 33 becomes the contents corresponding to the twenty-ninth day, the thirties day or the thirty-first day.

Numeral reference 57 is a gate circuit, which consists of an AND circuit 58 to which an even month detection output from the OR circuit 52, a thirty-first day detection output from the AND circuit 56 and an output from the position detecting device 9 passed through the AND circuit 32 are applied, a quad counter as year counter 59 which is constructed by a two bits binary counter and counts the set pulse and year pulse 45*a* produced from the AND circuit 45 in the month counter 34, an OR circuit 60 to which two-bits output from the year counter 59, an AND circuit 61 to which a twenty-ninth day detection output from the AND circuit 54 in the date detecting circuit 53 and the output from the OR circuit 60 are applied, an OR circuit 62 to which a thirtieth day detection output produced from the AND circuit 55 in the date detection circuit 53 and the output from the AND circuit 61 are applied, an AND circuit 63 to which a February detection output produced from the AND circuit 47 in the month detecting circuit 46, the output from the OR circuit 62 and the detection pulse 9*a* which is produced from the position detecting device 9 and passed through the AND circuit 31 are applied, an OR circuit 64 to which each output of the AND circuits 58 and 63 are applied, two FFs 67 and 68, an AND circuit 65 to which the detection output from the positional detecting device 9 and the Q output of the FF 67 are applied, an OR circuit 66 to which the outputs of the OR circuit 64 and the AND circuit 65 are applied, and an OR circuit 69 to which the output 64 of the OR circuit 64 and the coincidence signal of a coincidence detecting circuit 106 mentioned below are applied. The $\overline{Q}$ output of the above-mentioned FF 67 is applied to the AND circuit 32, the output of the AND circuit 65 is applied to the clock terminal CL of the FF 68, the output of the OR circuit 66 is applied to the clock terminal CL of the FF 67, the output of the OR circuit 69 is applied to the reset terminal R of the FF 68, and the coincidence signal from the coincidence detecting circuit 106 is applied to the reset terminal R of the FF 67. A correcting instruction signal for reverse rotating the stepping motor 6 in high speed is produced from the Q terminal of the FF 67 and a correcting instruction signal for forward rotating the stepping motor in high speed is produced from the Q terminal of the Ff 68. FFs 67 and 68 are operated by the rising edge of the pulse supplied to the clock terminals CL thereof.

In case that the month detecting circuit 46 detects any even month of April, June, September and November, and the detection signal from the OR circuit 52 is "1", when the counting contents of the date counter 33 is changed from the thirtieth day to the thirty-first day by the detection pulse 9*a* from the position detecting device 9 just after finishing the condition when the displayed dated of the calendar mechanism 8 is changed from the thirtieth day to the thirty-first day, with the result that the output of the AND circuit 56 in the date detecting circuit 53 becomes "1", the pulse responsive to the detection pulse 9*a* is produced from the AND circuit 58 in the gate circuit 57. The pulse produced from the AND circuit 58 is supplied to the clock terminal CL of the FF 67 through the OR circuits 64 and 66, and the Q output of the FF 67 becomes "1". An instruction for rotating the stepping motor 6 in the reverse direction with high speed in response to the condition that Q output of FF 67 becomes "1" is applied to the forward/reverse rotation control circuit 4. When the date driving wheel 11 of the calendar mechanism 8 rotates in the reverse direction with the reverse rotation of the stepping motor 6 and reaches the starting position $T_1$, the switch 22 is changed from on condition to off condition and the detection pulse is produced from the positional detecting device 9. In this case, since the $\overline{Q}$ output of the FF 67 is "0" the detection pulse at this time is not able to pass through the AND circuit 32. As a result, the counting contents of the date counter 33 is not changed. However, since the Q output of the FF 67 is "1", the detection pulse is applied to the clock terminal CL of the FF 68 through the AND circuit 65 and to the clock terminal CL of the FF 67 through the OR circuit 66. As a result of which, at the same time when the Q output of the FF 67 becomes "0" and the above-mentioned reverse rotating instruction is cut off, the instruction for rotating the stepping motor 6 in the forward direction with high speed is applied to the forward/reverse rotation control circuit 4 in response to the condition that the Q output of the FF 68 becomes "1". When the date driving wheel 11 of the calendar mechanism 8 starts to rotate in the forward direction from the starting position $T_1$ and reaches the finishing position $T_2$ with the forward rotation of the stepping motor 6, the condition of the switch 22 is changed from the on condition to the off condition, and the detection pulse 9*a* is produced from the positional detecting device 9. Since the Q output of the FF 67 has already been "0" and the $\overline{Q}$ output been "1", the detection pulse 9*a* is not able to pass through the AND circuit 65 and the pulse 9*a* passes through the AND circuit 32. Therefore, the counting contents of the date counter 33 will be changed from the thirty-first day to the first day and at the same time the counting contents of the month counter 34 will be changed to that of the next month by the set pulse and month pulse 40*a* produced from the AND circuit 40. As a result of which, no output is produced from the month detecting circuit 46 and the date detecting circuit 53, the output of the OR circuit 64 in the gate circuit 57 is maintained to be "0" and any clock pulse is not applied to FF 67. In addition, the forward rotation of the date driving wheel 11 from the starting position to the finishing position send the date plate 17 by one frame, and the date displayed by the calendar mechanism 8 is changed from the thirty-first day to the first day.

After the date driving wheel 11 passes through the finishing position $T_2$, the FF 68 is reset in response to producing the incidence signal from the incidence detecting circuit 106 and the Q output becomes "0". As a result, the high speed forward rotation controlling made by the forward/reverse rotation control circuit 4 is stopped and the stepping motor 6 rotates in the forward direction with normal speed.

Above explanation is the case in which the counting contents in the month counter 34 is any even month of April, June, September and November. In the case of February as the even month, it operates as follows: First of all, when the year is not the leap year in which any of bit outputs in the year counter 59 counting the year pulse from the month counter 34 is to be "1", the output of the AND circuit 54 detecting that the output of the date detecting circuit 53 corresponds to the twenty-ninth day becomes "1" in response to the condition when the date displayed by the calendar mechanism 8 is changed from the twenty-eighth day to the twenty-ninth day, and the outputs from the AND circuit 61 and the OR circuit 62 in the gate circuit 57 also becomes "1". Thus, the pulse corresponding to the detection pulse 9*a* from the position detecting device 9 is produced from the AND circuit 63. This pulse is applied to the FF 67 as clock pulse and the stepping motor 6 starts to rotate in the reverse direction with high speed. When the date driving wheel 11 is returned to the original position and the detecting pulse is produced from the position detecting device 9 again, the rotational condition of the stepping motor 6 is switched to the high speed forward rotation. When the counting contents of the date counter 33 becomes that corresponding to the thirtieth day in the case in which the date driving wheel 11 reaches the finishing position $T_2$ and the detection pulse 9*a* is produced from the positional detecting device 9, the date detecting circuit 53 detects it and the output of the AND circuit 55 will become 1. Therefore, the output of the OR circuit 62 also become 1, and the pulse corresponding to the detection pulse 9*a* is derived from the AND circuit 63. By the pulse the F.F. 68 is reset, and then the stepping motor 6 stops to rotate in the forward direction with high speed. At the same time, due to supplying of the clock signal, the output of the FF 67 is reversed and the stepping motor 6 is made to rotate in the reverse direction with high speed. At the time when the date driving wheel 11 returns to the starting position $T_1$, as seen from the above-mentioned operation, the stepping motor 6 stops to rotate in the reverse direction with high speed, and then is made to rotate in the forward direction with high speed. When the date driving wheel 11 reaches the finishing position $T_2$, the counting contents of the date counter 33 changes to the thirty-first day from the thirtieth day, and the output of the AND circuit 56 in the date detecting circuit 53 becomes 1. The operation after this is the same as the operation in the even months except for February. That is, the stepping motor 6 is driven to rotate in the reverse direction with the high speed, in addition, to rotate in the forward direction with the high speed. After the counting contents of the date counter 33 becomes that corresponding to the first day, the stepping motor continues to rotate in the forward direction with high speed till the coincidence signal is produced from the coincidence detecting circuit 106 and then producing the coincidence signal makes it to return to the normal operation. During the above operation, the date plate 17 of the calendar mechanism 8 is sent by three frames in whole, as a result of which, after the finish of displaying the twenty-eighth day the displayed dates of the twenty-ninth day, the thirtieth day and the thirty-first day is sent in a moment, and displayed date becomes the first day.

On the other hand, in the case of the leap year in which each bit outputs of the year counter 59 is "0", since the output of the AND circuit 51 becomes "0" though the date detecting circuit 53 detects the twenty-ninth day and the output of the AND circuit 54 is "1", the correction for the calendar is not made though the displayed date is changed to the twenty-ninth day. When the displayed date becomes the thirtieth day, the foregoing correction for the calendar is made in response to the condition that the AND circuit 55 detects the thirtieth day. Therefore, in February of the even month, the correction for the calendar is made at the time when the displayed date changes to the thirtieth day from the twenty-ninth day, the date plate 17 of the calendar mechanism 8 is sent by two frames in whole, and the displayed date is automatically corrected to be the first day after finishing the display of the twenty-ninth day.

In the foregoing explanation, the month change detecting device 10 had been explained in detail. Now, with respect to the forward/reverse rotation control circuit 4 and the drive circuit 5 which operate in response to the detection output from the device 10, the explanation will be made in detail.

The pulse producing from the pulse generating circuit 3 and having a frequency of 1 Hz is normally applied to the drive circuit 5 through an AND circuit 72 and an OR circuit 73. The Q outputs of FFs 67 and 68 in the month change detecting device 10 is inversed by inverters 70 and 71, respectively, and the inversed Q outputs are applied to the AND circuit 72.

The drive circuit 5 composes of a FF 74 to the clock terminal CL of which the output of the OR circuit 73 is applied, a NAND circuit 75 to which the Q output of the FF 74 and the output of the OR circuit 73 are applied, a NAND circuit 76 to which the $\overline{Q}$ output of the FF 74 and the output of the OR circuit 73 are applied, inverters 77 and 78 for inverting the outputs of NAND circuits 75 and 76, respectively. The coil 6*a* of the stepping motor 6 is connected between the outputs of inverters 77 and 78. The drive circuit 5 supplies the reverse rotating pulse to be positive or negative in appearance to the coil 6*a* in response to the pulse supplied to the clock terminal CL of the FF 74. Since the operation thereof is well known, the explanation of it is omitted.

A reverse rotation control circuit in the forward-/reverse rotation control circuit is shown by numeral reference 79. The reverse rotation control circuit 79 consists of an AND circuit 80 to which the Q output of the FF 67 in the month change detecting device 10 and the pulse having a frequency of 63 Hz produced from the pulse generating circuit 3 are applied, an AND circuit 81 to one input terminal of which the output of the AND circuit 80 is applied, a current level detecting circuit 82 which consists of resistors 83 and 84 and a N-channel-type MOS transistor 85, inverts the current flowing through the coil 6*a* into the voltage correspond to that, and detects the current level, an inverter 86 which consists of a resistor 87 and a N-channel MOS transistor 88 and inverts the polarity of the output from the current level detecting circuit 82, an inverter 89 inverting and amplifying the output of the inverter 86, an inverter 90 inverting the output of the inverter 89, a FF 91 which operates by rising edge of the clock signal applying to the clock terminal CL thereof, a FF 92 to the clock terminal CL of which the $\overline{Q}$ output of the FF 91 is applied and which operates by the falling edge of the clock signal, an FF 93 to the clock terminal CL of which the Q output of the FF 92 is applied and which operates by the falling edge, an OR circuit 94 to each input of which the $\overline{Q}$ outputs of FFs 92 and 93 are applied, respectively, and AND circuit 95 to which the $\overline{Q}$ output of the FF 91 and the output of the OR circuit 94 are applied, a NOR circuit 99 to one input terminal of which the output of the AND circuit 80 is applied directly, to the other input terminal of which the output of the AND circuit 80 delaying by the inverters 96, 97 and 98 is applied and which produces a reset pulse having the pulse width corresponding to the delay time in inverters 96, 97 and 98 when the logical output of the AND circuit 80 falls to "0" from "1". In the circuit 79, the output of the AND circuit 81 is applied to the OR circuit 73 and the reset terminal $\overline{R}$ of the FF 91, the output of the AND circuit 95 is applied to the AND circuit 81, and furthermore, the output of the NOR circuit 99 is applied to the reset terminals R of the FFs 92 and 93. This reverse rotation control circuit 79 controls to rotate the stepping motor 6 in the reverse direction by the pulse having a frequency of 63 Hz applied to the AND circuit 80, in response to the condition in which the Q output of the FF 67 in the month change detecting device 10 becomes "1". The operating condition thereof will be explained in detail later.

A forward rotation control circuit in the forward-/reverse rotation control circuit 4 is shown by numerical reference 100. The circuit 100 has an AND circuit 101 to which the Q output of the FF 68 in the month change detecting device 10 and the pulse having a frequency of 64 Hz and being produced from the pulse generating circuit 3 are applied, applied the pulse of 64 Hz to the drive circuit 5 through the OR circuit 73 in response to the condition in which the Q output of the FF 68 is to be "1", and makes the stepping motor 6 to rotate in the forward direction with high speed. The forward rotating control circuit 100 also has an AND circuit 102 to which the Q output of the FF 67 in the month change detecting device 10 and the pulse having a frequency of 64 Hz and being produced from the pulse generating circuit 3 are applied, an AND circuit 103 to which the Q output of the FF 68 in the month change detecting device 10, the pulse being produced from the pulse generating circuit 3 and having a frequency of 64 Hz are applied, a counter 104 counting the pulse having a frequency of 64 Hz passing through the AND circuit 102 at the time of the high speed reverse rotation of the stepping motor 6, a counter 105 counting the pulse having a frequency of 63 Hz passing through the AND circuit 103 at the time of the high speed forward rotation of the stepping motor 6, and a coincidence detecting circuit 106 which detects the coincidence condition between the counting contents of the counters 104 and 105, and produces a coincidence signal. The coincidence signal is supplied to the reset terminals R of the counters 104 and 105 and also to the reset terminals R of the FFs 67 and 68. The coincidence detecting circuit 106 is constructed in such a way that the coincidence signal is not produced when the counting contents of the counters 104 and 105 in the reset condition, that is, each bit outputs of the counters 104 and 105 are "0".

Next, the operation principle for the reverse rotation driving of the stepping motor by the reverse rotation control circuit 79 will be explained in conjunction with FIG. 9, FIG. 10 and so on.

Figure 9:
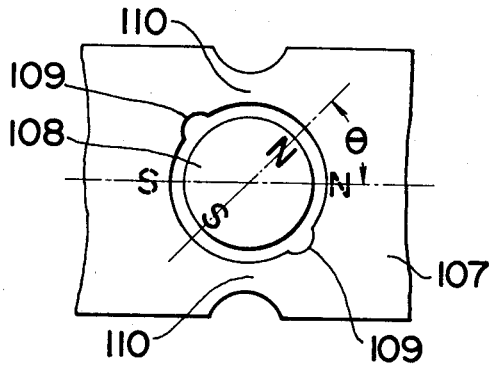
FIG. 9 is an outline view for roughly explaining a stepping motor used for an analogue type electronic watch.

The stepping motor, for example in the case of the two pole stepping motor, has a stator 107 coupled magnetically with a magnetic core (not shown) on which the coil 6*a* is wound as shown in FIG. 9, a rotor 108 magnetizing in two poles to the diametrical direction, a notch 109 which is defined in the stator 107 for determining the rotational direction of the rotor 108 and the standing still position thereof, and a saturable portion 110 which make to saturate the stator 107 magnetically. The rotor 108 stands still at the position of approximately 90° in the angle formed between the notch 109 and the magnetic poles of rotor at the time of non-operation condition. When the current is flowed through the coil 6*a* in such direction that the magnetic poles shown by dotted line is made in the stator 107, the rotor 108 rotates in the left direction, and stands still at the position where it rotates by 180° from the position as shown in the figure by interrupting the current. As mentioned above, the rotor 108 rotates in a predetermined direction with a predetermined step by applying the pulse changing the direction of the current to the coil 6*a*. When the direction of the current flowing through the coil is changed in such a way that the magnetic poles produced in the stator 107 becomes the reversed condition of that shown in the figure in order that the rotor 108 is rotated in the reverse direction, the rotor 108 is locked with the rotor 107 by the absorbing relationship in the condition rotating in the reverse direction by angle $\theta$, and then after interrupting the current the rotor 108 returns to the original standing still position wherein it is stabilized by controlling of the notch 109. For this reason, it is impossible to rotate the rotor 108 in the reverse direction only by inverting the direction of the current to flow through the coil. However, it is possible to drive it so as to rotate in the reverse direction by controlling the direction of the current to flow through the coil with proper timing.

Figure 8:
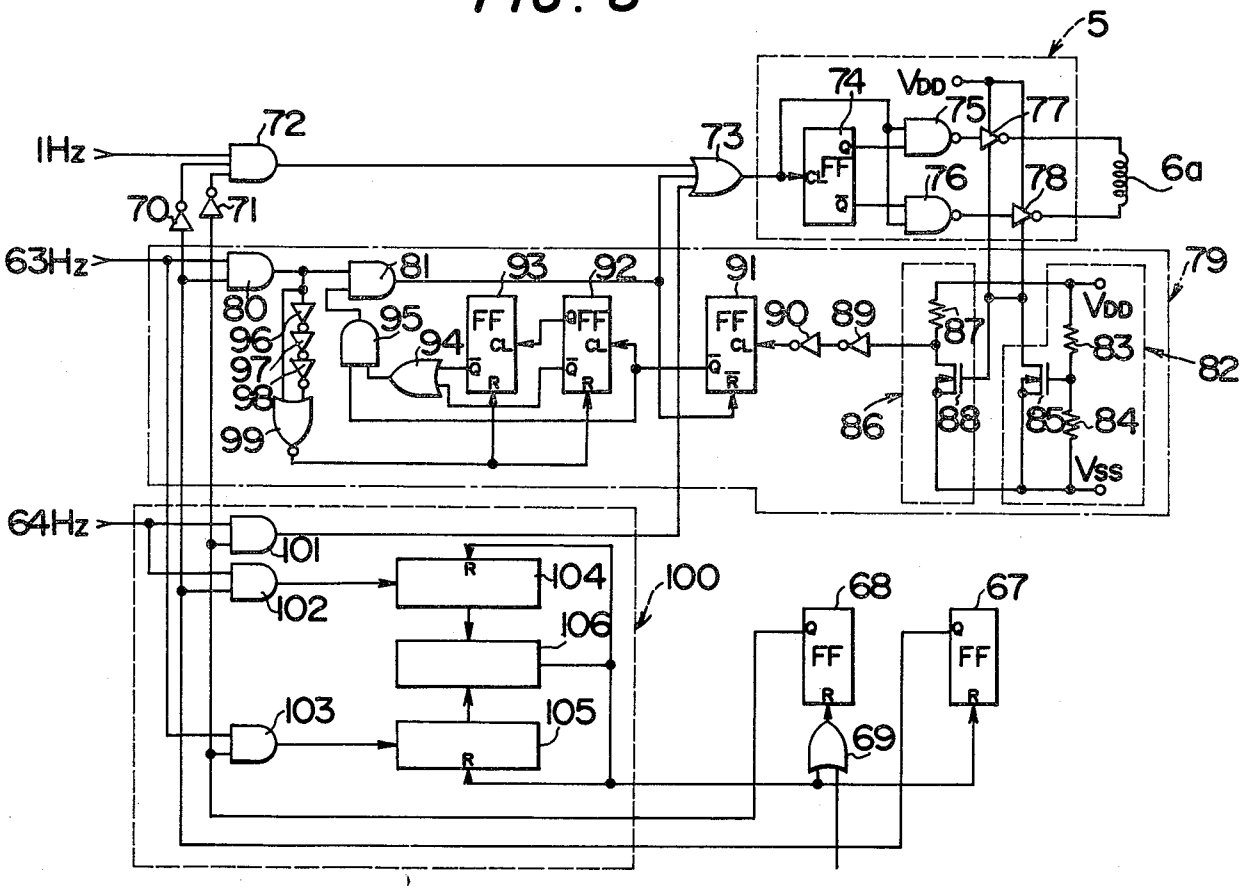
FIG. 8 is a wiring diagram for a forward/reverse rotation control circuit and a driving circuit shown in FIG. 1.
Figure 10:
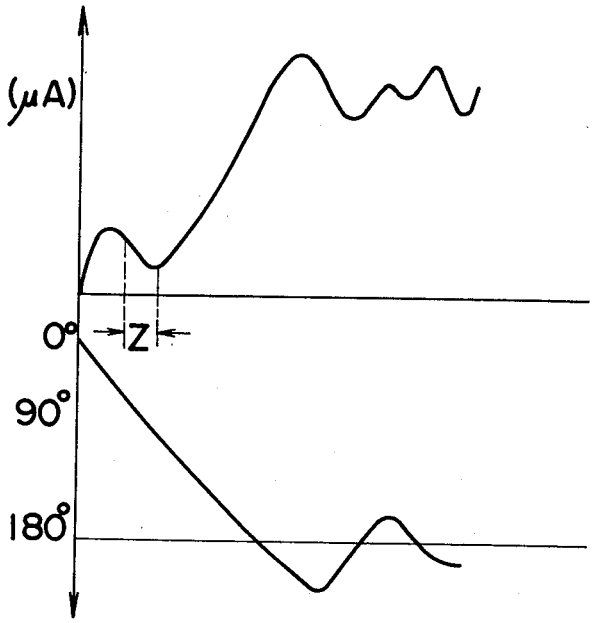
FIG. 10 is a waveform which shows a relationship between the rotational angle of the rotor in the stepping motor and the current flowing through the coil.

There is the relationship as shown by the waveform in FIG. 10 between the rotational angle of the rotor 108 and the current flowing through the coil 6*a*. The current is decreased at once, in the range of Z between the moment the rotor 108 starts to rotate and the time the magnetic pole posses through the notch 109, after this, the magnetic resistance of the magnetic circuit seen from the coil 6*a* is increased by the magnetic saturation in the saturable portion 110 of the stator 107, the time constant in the resistor-coil series circuit becomes small, and then the current stand up suddenly. The reverse rotation detecting circuit 79 shown in FIG. 8 detects that the current level is within the range of Z by the current level detecting circuit 82 and the inverter 86, controls the direction of the current flowing through the coil with the proper timing by use of the detecting result, and drives the rotor 108 to rotate in the reverse direction. The principle of operation is as follows:

At first, in the condition in which the rotor 108 is in the standing still position as shown in (A) of FIG. 11, when the driving pulse to rotate the rotor 108 in the normal direction is applied to the coil 6*a* and the current level comes to the position of Z, the driving pulse to make the direction of the current inverted direction is produced. However, the magnetic flux generated by the driving pulse in the opposite direction can not give the effect to the rotor 108 immediately due to the self-inductance of the coil 6*a*. Therefore, during this time, the rotor 108 continues to rotate by its inertia, and rotates to the position shown by (B) in FIG. 11. At this position, the rotor 108 is rotated in the reverse direction by the repulsion force caused by the inverted magnetic pole of the stator 107 as shown by (C) in FIG. 11. The current level becomes the level within the range of Z at the position shown by (D) in FIG. 11, and at this time the direction of the current flowing through the coil 6*a* is inverted. Since the magnetic flux generated by the inverted current as well as the magnetic flux described foregoing can not give the effect to the rotor 108 due to the self-inductance of the coil 6*a*, the rotor 108 continues to rotate, and when coming to the position shown by (E) in FIG. 11 the rotor 8 keep to rotate in the reverse direction by the repulsion force of the inverted magnetic pole of the stator 107. After this, the rotor 108 stands still at the stable position controlled by the notch 109 by interrupting the current flowing through the coil 6*a*, and then is in the condition turned by a half of turn from the condition shown by (A) in FIG. 11. In regard to each pulses produced from the pulse generating circuit 3 and having a frequency of 63 Hz, the reverse rotation control circuit 79 controls the direction of the current flowing through the coil 6*a* at the above-mentioned timing, and drives to rotate the stepping motor 6 in the reverse direction in synchronization with the above mentioned pulse. The operation of the whole circuit will be explained in conjunction with the timing chart shown in FIG. 12.

Figure 11A:
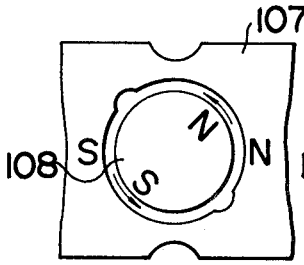
FIG. 11 is an illustrative diagram for explaining the operation principle for rotating the rotor in the reverse direction; and, FIG. 12 is a timing chart for explaining the operation of a reverse rotation control circuit shown in FIG. 8.
Figure 11B:
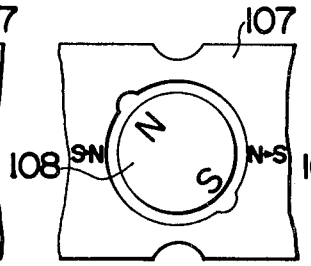
Figure 11C:
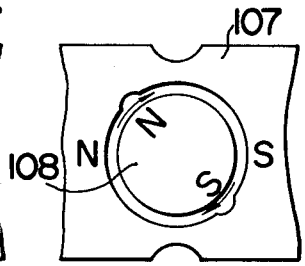
Figure 11D:
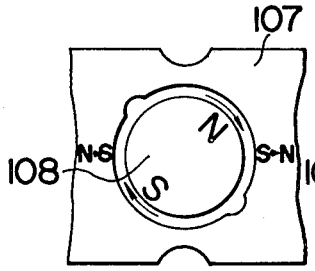
Figure 11E:
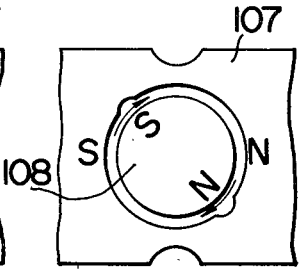
Figure 12:
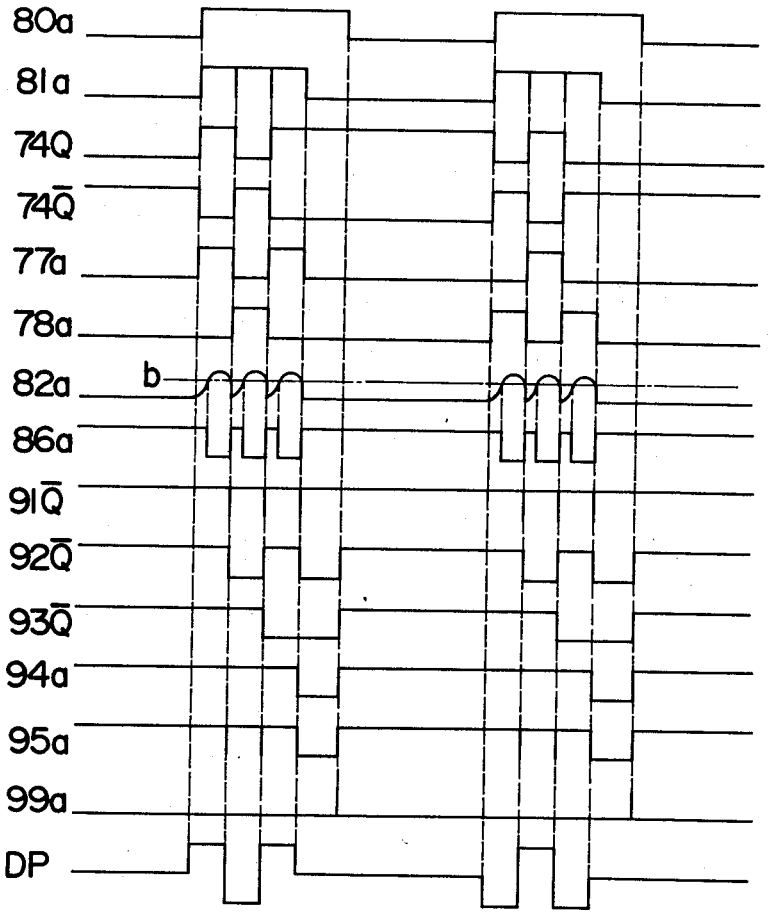

In FIG. 12, reference numeral 80*a* shows the pulse having a frequency of 63 Hz and passing through the AND circuit 80, and at the rising time thereof, the $\overline{Q}$ output (waveform 91$\overline{Q}$) of the FF 91, the $\overline{Q}$ output (waveform 92$\overline{Q}$) of the FF 92 and the $\overline{Q}$ output (waveform 93$\overline{Q}$) of the FF 93 are "1", respectively. Therefore, as shown by waveforms 94*a* and 95*a*, the outputs of the OR circuit 94 and the AND circuit 95 are also "1", and the output of the AND circuit 81 shown by reference 81*a* rises to "1" at the same time of the rising of the pulse having a frequency of 63 Hz. When the output of the AND circuit 81 is applied to the clock terminal CL of the FF 74 and the NAND circuits 75 and 76 through the OR circuit 73, Q and $\overline{Q}$ outputs of the FF 74 and the outputs of the inverters 77 and 78 inverting the outputs of the NAND circuits 75 and 76 are changed as shown by 74Q, 74$\overline{Q}$, 77*a* and 78*a* at the rising time of the output of the NAND circuit 81. Therefore, the driving pulse shown by DP is applied between the terminals of the coil 6*a* in appearance, and, first of all, the rotor 108 rotates to the position shown by (B) in FIG. 11 from the position shown by (A) therein. When the current flowing through the coil 6*a* is changed as foregoing explanation and the output voltage from the current level detecting circuit 82 becomes higher level than the detecting level b as shown by the waveform 82*a*, the output of the inverter 86 is changed to "0" from "1" as shown by the waveform 86*a*. The output of the FF 91 is not changed by the output change of the inverter 86 at this time. When the current flowing through the coil 6*a* begins to decrease in the range of Z, as mentioned above and the output voltage of the current level detecting level b, the output of the inverter 86 rises to "1". The output of the FF 91 is inverted by rising the output, once the $\overline{Q}$ output thereof changes to "0", and at the same time the outputs of the NAND circuits 95 and 81 becomes "0". In response to the condition in which the output of the NAND circuit 81 becomes "0", the FF 91 is reset and the $\overline{Q}$ output becomes "1" again. The output of the AND circuit 81 also becomes "1" in response to the condition. The output of the FF 74 is inverted in response to the condition in which once the output of the AND circuit 81 becomes "0" and after this becomes "1", and at the same time the driving pulse DP is changed in polarity. As a result of which, the direction of the current flowing through the coil 6*a* is changed, and the rotor 108 is rotated in the reverse direction as shown in FIG. 11(C). When the output of the inverter 86 is changed to "0" from "1" and furthermore changed to "1" from "0" in response to the change of current flowing through the coil 6*a*, the output of the FF 91 is changed as described above, at the same time the output of the AND circuit 81 is changed and the output of the FF 74 is inverted. The position of the rotor 108 at this time is shown in FIG. 11(D). The polarity of the driving pulse DP is changed in response to inverting the output of the FF 74, and then the rotor 108 continues to rotate in the reverse direction by repulsion of the magnetic pole produced in the stator 107 as shown in FIG. 11(E). When the output of the inverter 86 is changed to "0" from "1" and furthermore changed to "1" from "0" again, in response to the change of current flowing through the coil 6*a*, the output of the FF 91 is changed as described foregoing. In response to the output change of the FF 91 and the output changes of the above two times, both $\overline{Q}$ outputs of the FFs 92 and 93 becomes "0" as shown by 92$\overline{Q}$ and 93$\overline{Q}$. Therefore, the output of the OR circuit 94 becomes "0" and the outputs of the AND circuits 95 and 81 also become "0". As a result of which, both outputs of inverters 77 and 78 becomes "0", the current flowing through the coil 6*a* is interrupted, and the stepping motor 6 stand still at the position where the rotor 108 rotates by a half of turn from the position shown in FIG. 11(A). After this, when the pulse having a frequency of 63 Hz falls, the reset pulse as shown by the waveform 99*a* is produced from the NOR circuit 99 by falling of the pulse, and FFs 92 and 93 are reset. When the pulse having a frequency of 63 Hz rises again, the above-mentioned operation is repeated again, and the stepping motor 6 is rotated in the reverse direction with high speed in synchronization with the pulse of 63 Hz. In addition, the MOS transistor 85 in the current level detecting circuit 82 is to be a load resistor to change the current flowing through the coil 6*a* into the voltage correspond to that, and the resistance pulse thereof is determined by the electrical characteristics thereof and the bias voltage depending on the resistors 83 and 84. Practically, the resistance pulse thereof is determined in such a way that when the current is within the range of Z, the output voltage reaches the detecting level b, and then the output of the inverter 86 comprising the resistor 87 and the MOS transistor 88 can be inverted, and furthermore, the stepping motor 6 is not changed in the performances.

The reverse rotation control circuit 79 operates only when the Q output of the FF 67 in the month change detecting device 10 becomes "1" and the pulse of 63 Hz passes through the AND circuit 80. In the normal condition, the output of the AND circuit 81 maintains to be "0", and the FF 91 has been reset.

Next, the operation of the quick feed control circuit 100 will be explained.

When the Q output of the FF 67 in the month change detecting circuit 10 is to be "1" and the stepping motor 6 is rotated in the reverse direction with high speed, the pulse of 64 Hz passes through the AND circuit 102 and is counted by the counter 104. When the Q output of the FF 67 becomes "0" and the reverse high speed rotation of the stepping motor 6 is finished and at the same time the Q output of the FF 68 becomes "1", the pulse of 64 Hz passes through the AND circuit 101 and is supplied to the driving circuit 5 through the OR circuit 73. Therefore, the stepping motor 6 is rotated in the forward direction with high speed by the pulse of 64 Hz, and the pulse of 63 Hz passing through the AND circuit 103 is counted by the counter 105.

Counters 104 and 105 and the coincidence detecting circuit 106 measure the time required between the moment the date driving wheel 11 starts to rotate in the reverse direction at the time of the above-mentioned correction of the calendar and the moment the date plate 17 finishes to be sent by the forward rotation, and adjust the error in the displayed time of the display device 7 caused by correcting the calendar. The operation is based on the following principle. Now, assumption is made that when the stepping motor 6 is rotated to the reverse direction to correct the calendar the time required during the date driving wheel 11 is rotated in the reverse direction from the finishing position $T_2$ to the starting position $T_1$ is X second and the time that is required between the moment the date driving wheel 11 starts to rotate in the forward direction by the forward high speed rotation of the stepping motor 6 and the moment the counting contents of the counter 104 is coincident with that of the counter 105 is Y second. First of all, the counter 104 counts 64X pulses during the stepping motor is rotated in the reverse direction with high speed, and the counter 105 counts 63X pulses during the stepping motor is rotated in the forward direction with high speed. Since the coincidence detecting circuit 106 produced the coincidence signal when 64X is equal to 63X, following equalities are obtained:

$$63Y = 64X$$

$$64Y = 64X + Y$$

On the other hand, the number of pulses required to drive the stepping motor 6 at the time of reverse high speed rotation is 63X, and the number of pulses required at the time of high speed forward rotation is 54 Y. Then the difference between the number of pulses to drive the stepping motor 6 at the time of the high speed forward rotation and the number of pulses to drive the stepping motor 6 at the time of the high speed reverse rotation becomes 64y−63x, and from above described equations, the difference can be represented by $$64x + y - 63x = x + y.$$

Therefore, at the time of finishing the high speed forward rotation, the stepping motor 6 is driven unnecessarily in the forward direction as seen from the starting time of high speed reverse rotation by the amount correspond to the (x+y) pulses. As seen from this, the display time of the display device 7 at the time when the calendar correction is finished becomes the normal time in which the time of (x+y) seconds required for correcting the calendar is compensated. In addition, the pulses used for high speed forward rotation and high speed reverse rotation of the stepping motor is not limited signals having frequencies having the values of 63 Hz and 64 Hz. Any two signals having a frequency difference of 1 Hz between them can be used as these signals.

A correcting device for calendar is an analogue type electronic watch according to the present invention has been explained in detail on the basis of an embodiment shown in the figures. However, the present invention is not limited to the embodiment shown in figures, and can be changed and modified variously.

As described above, the present invention is the correcting device for a calendar in an analogue watch in which the output from the month change detecting device for detecting the change in month from the even month to the odd month makes the stepping motor to rotate in the forward direction with high speed by use of the reverse rotation control circuit, the data driving wheel in the calendar mechanism is returned to the starting position where the date plate is started to send every frame, after this, the stepping motor is made to rotate in the forward direction with high speed, the date driving wheel is made to rotate in the forward direction with high speed from the starting position where the date plate is started to send every frame to send the date plate, and the displaying date is changed to the first day from the thirty-first day in one stroke in the case of changing month from a thirtieth day of the even month to an odd month. Therefore, the present invention has advantages in which the user of the watch according to the present invention can save his trouble for correcting the calendar thereof, there is no danger in which in the case of correcting a calendar the watch circuit is made to reset, and since correcting the calendar is entirely made by the electronic way, the cost can be decreased. Thus, according to the present invention, the expected object can be attained, and the effect is striking.

I claim:

1. A stepping motor driven timepiece, comprising: a stepping motor; an analog time display mechanism driven by said stepping motor; a calendar display mechanism driven by said time display mechanism and including a 31-day date indicating member and a date driving wheel for driving said 31-day date indicating member when said date driving wheel is driven in a forward direction, and said date driving wheel being ineffective to drive said date indicating member when said date driving wheel is driven in a reverse direction; controllable motor driving means including a time standard oscillator for driving said stepping motor and normally operative to drive the time display mechanism and the calendar display mechanism forward at normal time and date advancing speed; and a month change detecting device including means for detecting a month change from an even days month to an odd days month, said month change detecting device including control circuit means cooperative with said calendar display mechanism and said means for detecting a month change for controlling said motor driving means to return said date driving wheel to a starting date advancement position at which said date driving wheel starts to advance at the end of an even days month, for then controlling said motor to rotate at high speed in the forward direction until the date displayed by said date indicating member has rapidly passed through a position displaying the 31st day of the month to a position displaying the first day of the month and said date driving wheel is at an advance completed position, and for thereafter allowing said motor to drive said calendar display mechanism at the normal speed, when the time displayed is normal time.

2. A timepiece as claimed in claim 1, and further including a date driving wheel position detecting switch which is actuated by said date driving wheel and which is closed in one of the aforesaid date advancement positions and closed in the other date advancement position, and a switching circuit for generating pulses when said switch is in a predetermined condition and for applying the pulses to said control circuit means to indicate when said date driving wheel is at a date advancement position.

3. A timepiece as claimed in claim 2, wherein the month change detecting device includes a date counter for counting pulses generated by said switching circuit when the date advance completed position is detected for developing a count representative of the date.

4. A timepiece as claimed in claim 3, wherein said month change detecting device includes a 12-counter for counting month pulses from said date counter, month detecting circuit means for detecting when the count in the month counter corresponds with an even days month, date detecting circuit means for detecting when the count in the date counter corresponds with the 31st day, and said control circuit means comprises a gating circuit for producing a calendar correcting signal in response to a detection output signal from said date detecting circuit and a detection output signal from said month detecting circuit.

5. A timepiece as claimed in claim 4, wherein the date detecting circuit means is effective for detecting when the count in the date counter corresponds to the 29th or 30th day, the month change detecting circuit means includes a four-count year counter for counting year pulses produced from the month counter, and said gating circuit comprising said control circuit means in the month change detecting device is responsive to outputs from the date detecting circuit and the year counter for producing a correcting signal when the month detecting circuit detects February and for applying the correcting signal to change the count content of the date counter to correspond with the 29th, 30th or 31st day in a non leap year or to correspond with the 30th or 31st day in a leap year.

6. A timepiece as claimed in claim 1, 2, 3, 4 or 5, wherein said controllable motor driving means comprises: reverse rotation control circuit means for securing high speed rotation of the motor in the reverse direction by driving pulses of one predetermined frequency; forward rotation control circuit means for securing high speed rotation of the motor in the forward direction by driving pulses of a frequency 1 Hz lower than said one frequency; a counter for counting the pulses supplied to the motor during forward rotation; a counter for counting the pulses supplied to the motor during reverse rotation; and a coincidence detector for detecting coincidence of the count contents of the two counters and which responds to produce a control signal for causing high speed forward rotation of the motor to cease.

7. A timepiece as claimed in claim 6, wherein the drive pulses applied to the motor for normal forward rotation, high speed forward rotation and high speed reverse rotation are, respectively, 1 Hz, 63 Hz and 64 Hz.

8. A timepiece as claimed in claim 1, 2, 3, 4 or 5, wherein the stepping motor is a stepping motor of the known kind having stator pole faces including notches for determining a rest position of the stepping motor rotor, further comprising means for reversing its direction of rotation including means for detecting the time when the current flowing through the stepping motor driving coil after a driving pulse has been applied thereto falls below a predetermined level.

9. A timepiece as claimed in claim 1, 2, 3, 4 or 5, wherein the calendar mechanism also includes a day indicating member driven by the calendar display mechanism and which is advanced with a predetermined time delay relative to the advancement of the date indicating member.

10. An analog type electronic watch which comprises: an oscillating circuit for generating an oscillating signal; a frequency dividing circuit for dividing the oscillating signal; a pulse generating circuit for generating pulse signals each having a respective predetermined period on the basis of output signals from the frequency dividing circuit; a stepping motor; drive circuit means for driving said stepping motor in synchronization with a pulse signal applied to said drive circuit; a display mechanism including pointers for displaying the time by the pointers and driven by said stepping motor; a calendar mechanism having a date driving wheel and a date plate which is advanced by one frame during a predetermined time slot by the rotation of the date driving wheel rotated by said display mechanism in a forward direction and which is unaffected by rotation of said date driving wheel in a reverse direction; and a correcting device for the calendar mechanism comprising position detecting means for detecting a starting position where rotation of said date driving wheel is started and a finishing position where rotation of said date driving wheel is finished, month change detecting means for generating a correcting signal by detecting the change from an odd month to an even month, reverse rotation control circuit means from said pulse generating circuit responsive to said correcting signal for applying to said drive circuit a selected one of said pulse signals effective to rotate said date driving wheel at high speed in the reverse direction from the finishing position detected by said position detecting means to the starting position, forward rotation control circuit means from said pulse generating circuit responsive to said correcting signal for applying to said drive circuit a selected one of said pulse signals effective to rotate said date driving wheel at high speed in the forward direction until said display mechanism displays a normal time and said date plate has advanced one frame.

11. A correcting device for a calendar in an analog type electronic watch as set forth in claim 10, wherein said position detecting means comprises a switch for being controlled ON and OFF in the predetermined rotational region of said date driving wheel, and switching circuit means for generating a detection pulse when said switch is opened.

12. A correcting device for a calendar in an analog type electronic watch as set forth in claim 11, wherein said month change detecting means comprises a date counter for counting the detection pulse which is generated when the finish position is detected by said position detecting means.

13. A correcting device for a calendar in an analog type electronic watch as set forth in claim 12, wherein said month change detecting means comprises a thirty-one advance date counter, a month counter which is a duo-decimal counter and counts month pulses produced from said date counter, a month detecting circuit for detecting the condition when the counted contents in said month counter corresponds to an even month, a date detecting circuit for detecting when the counted contents in said date counter corresponds to the thirty-first day, and means comprising a gate circuit for producing the correcting signal in response to a detection output signal produced from said date detecting circuit and a detection output signal produced from said month detecting circuit.

14. A correcting device for a calendar in an analog type electronic watch as set forth in claim 13, wherein said date detecting circuit in said month change detecting means detects when the counted contents in the date counter corresponds to the twenty-ninth day and the thirtieth day, said month change detecting means comprises a year counter which is a quad counter and counts a year pulse produced from the month counter, and the means comprising a gate circuit in the month change detecting means is effective to respond when the month detecting circuit detects February to produce the correcting signal which changes the counted contents in the date counter into the twenty-ninth day, the thirtieth day or the thirty-first day in the common years, and into the thirtieth day or the thirty-first day in a leap year in response to the outputs of the date detecting circuit and the year counter.

15. A correcting device for a calendar in an analog type electronic watch as set forth in claim 10, wherein the frequency of the pulse signal selected by the reverse rotation control circuit to rotate the stepping motor in the reverse direction is lower than the frequency of the pulse signal selected by the forward rotation control circuit to rotate the stepping motor in the forward direction by 1 Hz, said reverse rotation control circuit has a counter which counts the number of the pulses for rotating the motor in the forward direction at the time of forward rotation of the stepping motor, and a coincidence circuit which detects when the contents of the two counters are the same and produces a signal for stopping the forward rotation.

16. A correcting device for a calendar in an analog type electronic watch as set forth in claim 10, wherein said calendar mechanism has a day plate for displaying a day in addition to said date plate, and wherein there is a lag between the time slot during which the day plate is advanced and the time during which the date plate is advanced.

* * * * *